US008261718B2

(12) United States Patent
Shafer et al.

(10) Patent No.: US 8,261,718 B2
(45) Date of Patent: Sep. 11, 2012

(54) HIGH PRESSURE PUMP AND METHOD OF REDUCING FLUID MIXING WITHIN SAME

(75) Inventors: Scott F. Shafer, Morton, IL (US); Alan R. Stockner, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 360 days.

(21) Appl. No.: 11/981,875

(22) Filed: Nov. 1, 2007

(65) Prior Publication Data

US 2009/0114189 A1 May 7, 2009

(51) Int. Cl.
*F02M 57/02* (2006.01)

(52) U.S. Cl. ..... 123/446

(58) Field of Classification Search ..... 123/446, 123/364, 447, 500, 501, 502
See application file for complete search history.

(56) References Cited

U.S. PATENT DOCUMENTS

| | | | | |
|---|---|---|---|---|
| 4,478,423 | A | 10/1984 | Hjelsand et al. | |
| 4,480,623 | A * | 11/1984 | Thomas | 123/514 |
| 4,573,444 | A | 3/1986 | Howes | |
| 4,576,133 | A | 3/1986 | Silcock et al. | |
| 4,590,910 | A | 5/1986 | Lintott et al. | |
| 5,897,119 | A | 4/1999 | McMillen | |
| 5,901,686 | A * | 5/1999 | Stockner et al. | 123/495 |
| 5,979,415 | A * | 11/1999 | Sparks et al. | 123/506 |
| 5,983,863 | A | 11/1999 | Cavanagh et al. | |
| 5,992,768 | A | 11/1999 | Beatty et al. | |
| 6,634,459 | B1 | 10/2003 | Litkenhus et al. | |
| 6,805,105 | B2 | 10/2004 | Kato et al. | |
| 7,152,583 | B2 | 12/2006 | Abe et al. | |
| 7,234,448 | B2 | 6/2007 | Hanyu | |
| 7,240,856 | B2 * | 7/2007 | Abe | 239/102.2 |
| 7,287,517 | B2 * | 10/2007 | Nozaki et al. | 123/514 |
| 2002/0096145 | A1 | 7/2002 | Ricco et al. | |
| 2003/0108443 | A1 | 6/2003 | Suzuki et al. | |
| 2003/0219346 | A1 | 11/2003 | Abe et al. | |
| 2004/0021003 | A1 | 2/2004 | Hefler et al. | |
| 2006/0201484 | A1 | 9/2006 | Shafer et al. | |
| 2009/0114189 | A1 | 5/2009 | Shafer et al. | |

FOREIGN PATENT DOCUMENTS

| | | | |
|---|---|---|---|
| AT | 307808 | | 6/1973 |
| DE | 4030951 | | 4/1992 |
| DE | 19534286 | | 3/1997 |
| GB | 2237074 | | 4/1991 |
| GB | 2237074 A | * | 4/1991 |
| GB | 2305221 A | * | 4/1997 |
| WO | WO 2005/017360 | | 2/2005 |

* cited by examiner

*Primary Examiner* — Stephen K Cronin
*Assistant Examiner* — Sizo Vilakazi
(74) *Attorney, Agent, or Firm* — Miller, Matthias & Hull

(57) ABSTRACT

Mixing a pumped fluid with a lubrication fluid within a pump can undermine the lubricity of the lubrication fluid. In order to reduce mixing of fluids within a pump of the present disclosure, a pump is provided that comprises a housing, a piston, a first annulus, and a second annulus. The housing includes an inlet for the pumped fluid, an inlet for the lubrication fluid provided at a first pressure, and a piston bore fluidly coupled to the inlet for the pumped fluid. The piston is moveable within the piston bore. The first annulus is fluidly coupled to the inlet for the lubrication fluid. The second annulus is configured to be fluidly coupled to a drain circuit provided at a second pressure less than the first pressure. The first annulus and the second annulus are located along the length of the piston bore.

14 Claims, 4 Drawing Sheets

HIGH PRESSURE PUMP AND METHOD OF REDUCING FLUID MIXING WITHIN SAME

TECHNICAL FIELD

The present disclosure relates generally to high pressure pumps, and more specifically to reducing fluid mixing within a high pressure pump.

BACKGROUND

Lubrication fluid, such as oil, is generally pumped through a fluid pump in order to lubricate the moving parts of the pump. Mixing of the lubrication fluid with the fluid being pumped can undermine the lubricity of the lubrication fluid and/or contaminate the fluid being pumped with the lubrication fluid. For example, many fuel systems include a low pressure transfer pump that draws fuel from a fuel tank and a high pressure pump that increases the pressure of the fuel before injection. Lubrication fluid, generally oil, flows within the high pressure pump to lubricate the moving parts. Cam-driven, reciprocating pistons within piston bores of the high pressure pump increase the pressure of the fuel. The reciprocating motion of the piston and the pressure within the piston bore can cause some of the fuel to migrate between the piston and the piston bore. If the fuel is permitted to migrate outside of the piston bore and into a cam-housing region, the fuel will directly mix with oil, decreasing the lubrication quality of the lubrication oil, which can lead to potentially serious problems throughout the lubrication system.

In order to reduce the fuel migration between the reciprocating piston and the piston bore, it is known to position a seal, such as an o-ring, between the piston bore and the reciprocating piston to block the migration of the fuel into the lubrication oil system. However, many fluid pumping, reciprocating pistons can be subjected to relatively extreme pressure changes, thereby reducing the life and the sealing capability of the seals.

In order to relieve the pressure on an o-ring, and further reduce fluid mixing, a fluid seal, described in U.S. Pat. No. 5,901,686, issued to Stockner et al. on May 11, 1999, is designed for a fuel injector that includes a reciprocating piston within a piston bore including a pressurization chamber in which fuel pressure is increased. The fluid seal includes an annular pressure accumulation volume defined by the piston and positioned between the pressurization chamber and the o-ring. A fuel injector body defines a pressure release passage, positioned between the accumulation volume and the pressurization chamber when the plunger is in the retracted position, that fluidly connects the piston bore to a low pressure return line.

As fuel migrates between the piston bore and the piston when the piston advances to pressurize the fuel within the pressurization chamber, pressure on the o-ring is reduced by some of the fuel flowing from the bore to the pressure release passage while another portion of the fuel accumulates within the pressure accumulation volume. When the pressure accumulation volume of the advancing piston is aligned with the pressure release passage, the pressure on the o-ring dramatically drops as a result of the pressure accumulation volume dropping to the same low pressure as the low pressure return line. The pressure within the accumulation volume will again build when the piston advances past the pressure release passage until the injection event ends.

Although the pressure on the o-ring is reduced by the combination of the pressure accumulation volume and the pressure release passage, the fuel migrating up the piston bore is still permitted to migrate and accumulate within the piston bore for the majority of the pressure stroke of the piston. Only for the brief time that the pressure accumulation volume is fluidly connected to the pressure release passage is the fuel within the pressure accumulation volume able to evacuate from the piston bore.

The present disclosure is directed at overcoming one or more of the problems set forth above or other problems.

SUMMARY

In one aspect of the present disclosure, a pump comprises a housing, a piston, a first annulus, and a second annulus. The housing includes an inlet for a first fluid, an inlet for a second fluid provided at a second pressure, and a piston bore fluidly coupled to the inlet for the first fluid. The piston is moveable within the piston bore and has a first end exposed to the first fluid and a second end exposed to the second fluid. The first annulus is fluidly coupled to the inlet for the second fluid. The second annulus is configured to be fluidly coupled to a drain circuit provided at a third pressure that is less than the second pressure. The first annulus and the second annulus are located along the length of the piston bore.

In another aspect of the present disclosure, a fuel system comprises a source of fuel, a source of lubrication fluid, a low pressure pump, a high pressure pump, and at least one fuel injector. The low pressure pump includes a low pressure pump inlet and a low pressure pump outlet. The low pressure pump inlet is fluidly coupled to the source of fuel. The high pressure pump includes a housing, a piston, a first annulus, and a second annulus. The housing includes a high pressure pump inlet fluidly coupled to the low pressure pump outlet, a high pressure pump outlet, a lubrication fluid inlet, and a piston bore fluidly coupleable to the high pressure pump inlet and the high pressure pump outlet. The piston is moveable within the piston bore and has a first end exposed to the fuel and a second end exposed to the lubrication fluid. The first annulus is within the piston bore and fluidly coupled to the lubrication fluid inlet. The second annulus is within the piston bore and fluidly coupled to the low pressure pump inlet. The at least one fuel injector is fluidly coupled to the high pressure pump outlet. The lubrication fluid inlet is at a greater pressure than the low pressure pump inlet.

In yet another aspect of the present disclosure, a method for preventing a first fluid within a first chamber from mixing with a second fluid within a second chamber, where the first chamber and the second chambers are located on opposites ends of a bore and are separated by a component moveable within the bore, comprises the steps of fluidly coupling a third fluid source to a first portion of the bore. The method also includes the steps of pressuring the third fluid to a third pressure, fluidly coupling a fluid drain to a second portion of the bore, and maintaining the fluid drain at a drain pressure. The method further comprises the step of maintaining the third pressure at a pressure higher than the drain pressure so that the third fluid may flow from the first portion of the bore, between the component and the bore, to the second portion of the bore, and to the fluid drain.

DETAILED DESCRIPTION

Figure 1:
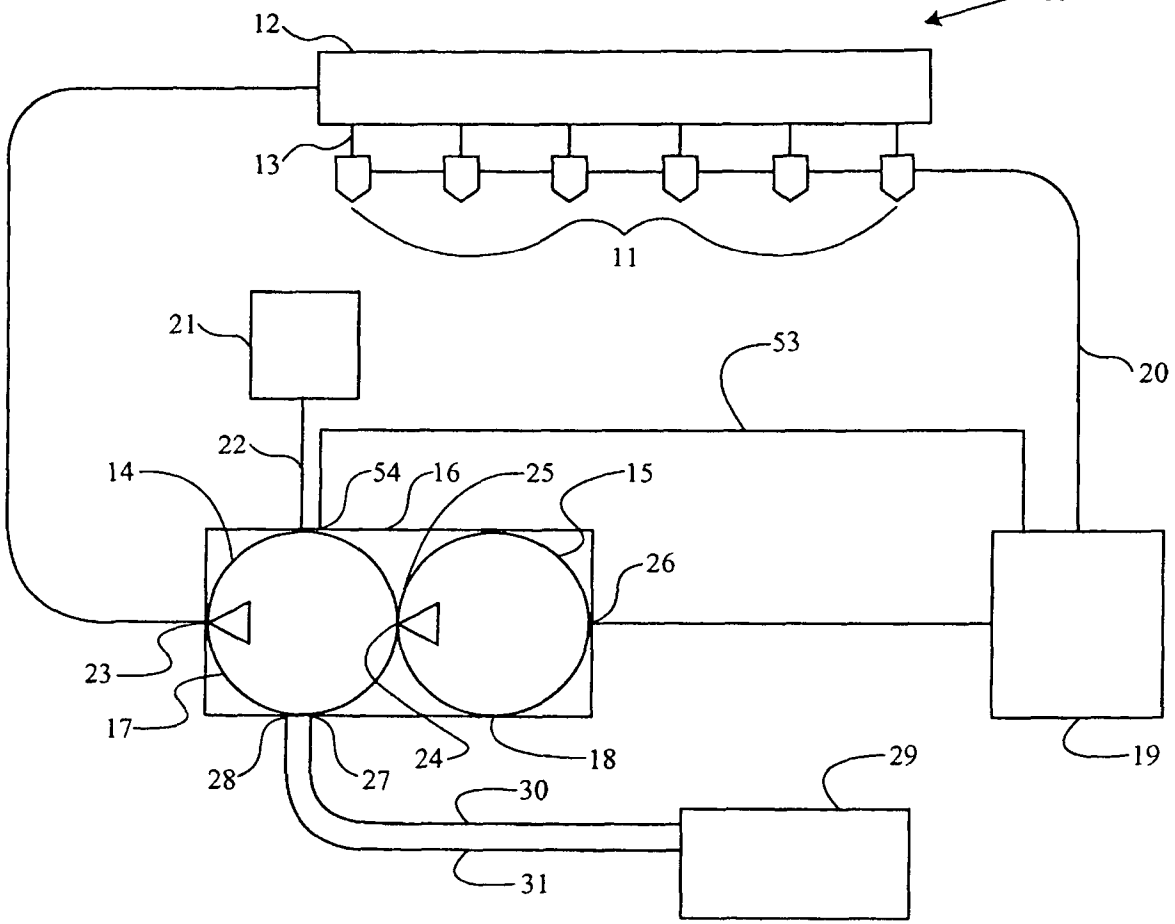
FIG. 1 is a schematic illustration of a fuel system, according to one embodiment the present disclosure.

Referring to FIG. 1, there is shown a schematic illustration of a fuel system 10, according to the present disclosure. The fuel system 10 includes a plurality of fuel injectors 11, which are each connected to a high pressure fuel rail 12 via individual branch passages 13. The high pressure fuel rail 12 is supplied with high pressure fuel from a high pressure pump 14 that is supplied with relatively low pressure fuel by a low pressure pump 15. A high pressure pump housing 17 of the high pressure pump 14 defines a high pressure pump outlet 23 fluidly connected to the fuel common rail 12 and a return line outlet 54 fluidly connected to a fuel tank 19 via a first return line 53. A low pressure pump housing 18 of the low pressure pump 15 defines a low pressure pump inlet 26 fluidly connected to the fuel tank 19, which is also fluidly connected to the fuel injectors 11 via a second return line 20. Although the present disclosure contemplates the high pressure pump 14 and the low pressure pump 15 being separate from one another in separate housings, in the illustrated embodiment, the low pressure pump 15 and the high pressure pump 14 may be both included within a compound pump assembly 16. The high pressure pump housing 17 of the high pressure pump 14 may be attached to the low pressure pump housing 18 of the low pressure pump 15 in a conventional manner, such as through the use of bolts. The low pressure pump housing 18 defines a low pressure pump outlet 25 that is fluidly connected to a high pressure pump inlet 24 defined by the high pressure pump housing 17. The high pressure pump housing 17 also defines a lubrication fluid inlet 27 and a lubrication fluid outlet 28. The lubrication fluid inlet 27 and the lubrication fluid outlet 28 are fluidly connected to a source of lubrication fluid 29, illustrated as an engine oil sump, via a lubrication supply line 30 and a lubrication return line 31, respectively. A pump (not shown) may be provided to draw lubrication fluid from the source of lubrication fluid 29 and pressurize the lubrication fluid for transport to the lubrication fluid inlet 29. The pressure to which the pump pressurizes the lubrication fluid may vary depending on the application. However, according to one exemplary embodiment, the lubrication fluid is maintained at a higher pressure than the low pressure pump inlet 26. In some situations, the lubrication fluid may be pressurized up to 600 kilopascals or more. In other situations or applications, the pressure of the lubrication fluid may be greater or less than 600 kilopascals.

The fuel system 10 is controlled in its operation in a conventional manner via an electronic control module 21 which is connected to the high pressure pump 14 via a pump communication line 22 and connected to each fuel injector 11 via communication lines (not shown). When in operation, control signals generated by the electronic control module 21 determine how much fuel displaced by the high pressure pump 14 is forced into the common rail 12 and at what time, as well as when and for what duration (indicative of fuel injection quantity) fuel injectors 11 operate. The fuel not delivered to the fuel common rail 12 can be re-circulated back to the fuel tank 19 via the first return line 53.

Figure 2:
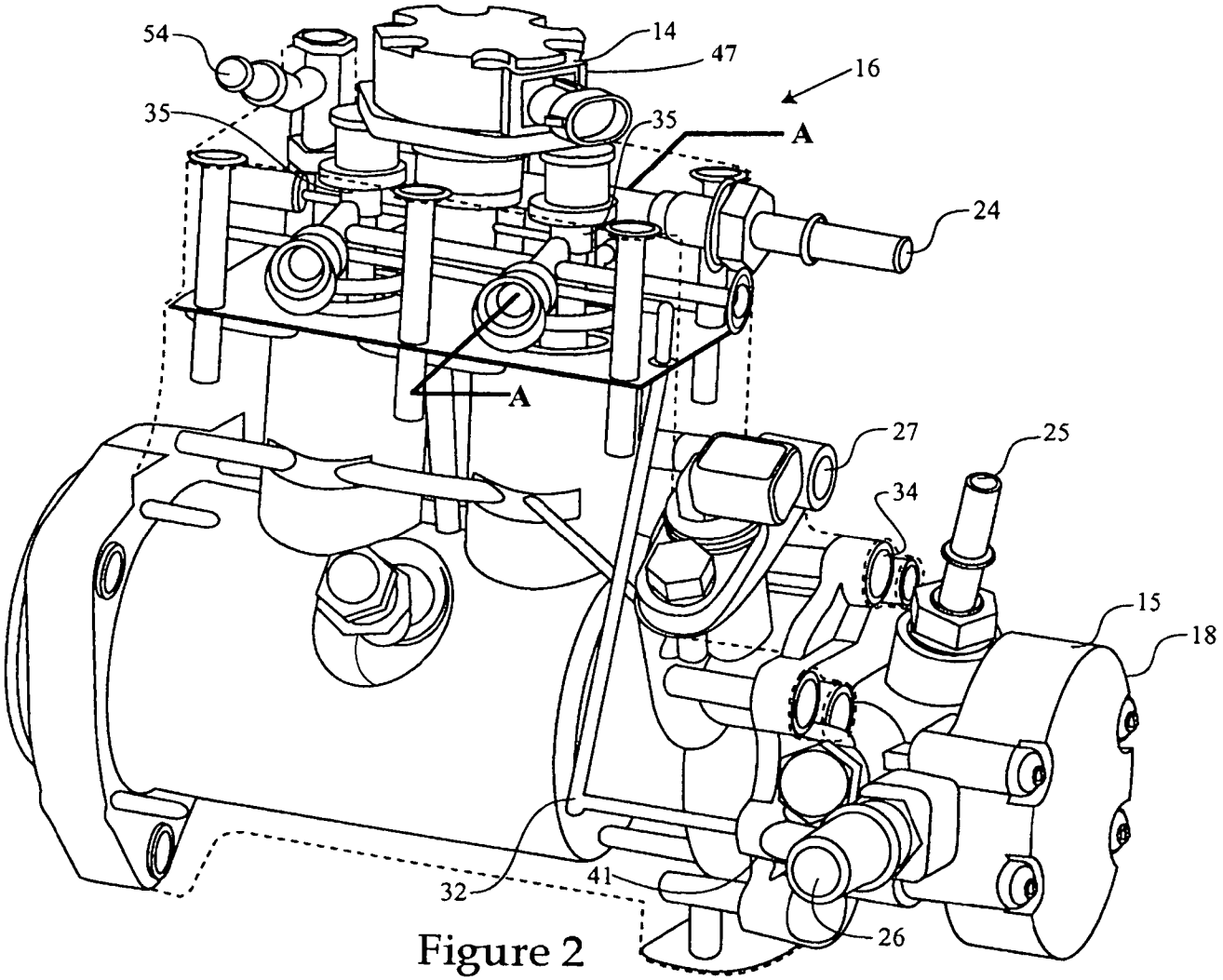
FIG. 2 is an isometric view of a compound pump assembly of the fuel system of FIG. 1.

Referring to FIG. 2, there is shown an isometric view of the compound pump assembly 16 within the fuel system 10 of FIG. 1. It should be appreciated that a portion of the high pressure pump housing 17 and a fluid communication line connecting the low pressure pump outlet 25 with the high pressure pump inlet 24 have been removed from the compound pump assembly 16 in order to illustrate the internal structure of the high pressure pump 14. A perimeter of the high pressure pump housing 17 is illustrated by a dotted line. The low pressure pump housing 18 defines a plurality of bolt bores 34 through which the high pressure pump housing 17 can be bolted to the low pressure pump housing 18. The high pressure pump housing 17 includes two barrels 35, each defining, in part, a piston bore 33 (shown in FIG. 3). A drain line 32 fluidly connects two annuluses 40 (shown in FIG. 3), each opening to a respective piston bore 33, to the low pressure pump inlet 26 of the low pressure pump 15, which acts as a drain circuit for the annuluses 40. Although the illustrated embodiment includes two piston bores, it should be appreciated that the pump 14 could include any number of piston bores, each opened to an annulus. The drain line 32 may be attached to the low pressure pump inlet 26 via a conventional T-connection 41. Thus, the drain line 32 fluidly connects the piston bore 33 which is generally at a relatively high pressure to low pressure fuel flowing into the low pressure pump 15, thereby creating a pressure differential. Those skilled in the art will appreciate that the greater the velocity of the fuel flow, the lower the pressure within the low pressure pump inlet 26. The lubrication fluid inlet 27 and outlet (not shown) allow oil to flow into and out of the high pressure pump housing 17 and lubricate the moving parts.

Figure 3:
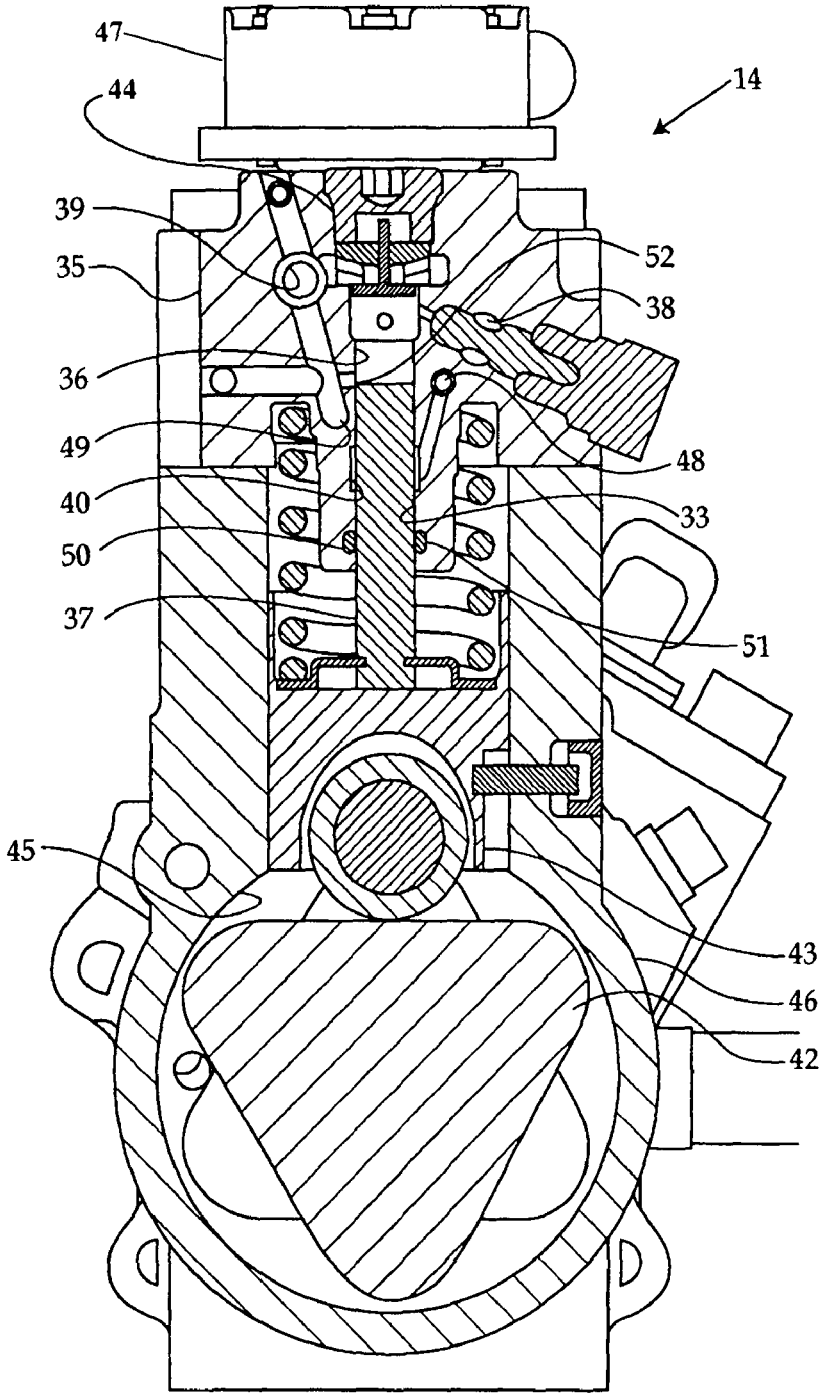
FIG. 3 is a side sectioned view along line AA of a high pressure pump of the compound pump assembly of FIG. 2.

Referring to FIG. 3, there is shown a side sectioned view of the high pressure pump 14 of the compound pump assembly 16 of FIG. 2. The barrel 35 that is part of the pump housing 17 defines the piston bore 33 in which a piston 37 reciprocates. Although only one piston 37 within one piston bore 33 is illustrated, it should be appreciated that both piston/piston bore pairs operate similarly. The piston 37 and the piston bore 33 define a pumping chamber 36 that is fluidly connectable to a high pressure gallery 38 and a low pressure fuel supply gallery 39. The high pressure gallery 38 is fluidly connected to the high pressure pump outlet 23, and the low pressure fuel supply gallery 39 is fluidly connected to the high pressure pump inlet 24. The piston 37 is coupled to a cam 42 via a tappet 43 in a conventional manner. The cam 42 rotates and the tappet 43 reciprocates within a cam region 45 defined by a cam housing 46. Although not shown, a second piston reciprocates with a second cam. According to one exemplary embodiment, the pair of cams are operable to cause the pistons to reciprocate out of phase with one another, and the cams are driven by the engine and rotate at a rate that synchronizes pumping activity to fuel injection activity. It should be appreciated that the cams, including cam 42, and the tappet 43 are lubricated by the flow of lubrication fluid. Thus, there is oil flowing within the cam region 45.

According to one exemplary embodiment, when the piston 37 is undergoing its retracting stroke, fresh low pressure fuel is drawn from the low pressure fuel supply gallery 39 past an inlet check valve 44 and into the pumping chamber 36. During this time, fluid communication between the pumping chamber 36 and the low pressure fuel supply gallery 39 via a spill control valve 47 is blocked. The spill control valve 47 includes an electrical actuator that can be used to control the spill control valve 47 during the pumping stroke in order to control the output from the pumping chamber 36. When the piston 37 is undergoing its pumping stroke and the control valve 47 is open, the pressure within the pumping chamber 36 moves a shuttle valve member (not shown) of the spill control valve 47 in order to fluidly connect the pumping chamber 36 to the low pressure fuel supply gallery 39 via the spill control valve 47. The fuel may be displaced from the pumping chamber 36 into the low pressure gallery 39 via the spill control valve 47. When the spill control valve 47 is closed, the fuel in the pumping chamber 36 will be pushed past an outlet check valve into the high pressure gallery 38 and into the high pressure common rail 12. Those skilled in the art will appreciate that the timing at which the electrical actuator is energized (e.g., the timing at which the spill control valve 47 is opened and closed) determines what fraction of the amount of fuel displaced by the piston action is pushed into the high pressure gallery 38 and what other fraction is displaced back to the low pressure gallery 39. Because the pistons are reciprocating out of phase with one another and the pumping chamber 36 is only connected to the low pressure fuel supply gallery 39 via the spill control valve 47 during the pumping stroke, the pumping chambers 36 can share one spill control valve 47. It should be appreciated that the systems and methods described herein contemplate use with various high pressure pumps, including pumps that vary pump input or output in a different manner than illustrated and pumps that do not have any variable discharge capabilities. For example, the systems and methods described herein may also be used with a pump having an electrically actuated spill control valve associated with each piston/piston bore pair, where the spill control valve is moveable between an open position in which the low pressure fuel supply gallery is fluidly connected to the pumping chamber and a closed position in which the low pressure fuel supply gallery is disconnected from the pumping chamber. As with the embodiment described above, the timing at which the electrical actuator associated with each spill control valve is energized determines what fraction of the amount of fuel displaced by the piston action is pushed into a high pressure gallery and what other fraction is displaced back to the low pressure gallery.

According to one exemplary embodiment, the annulus 40 (also known as a weep annulus) opens to the piston bore 33 and is fluidly connected to the drain line 32 via a drain gallery 48 defined by the high pressure pump housing 17. The barrel 35 optionally defines a seal groove 50 in which seal 51 may be positioned. Seal 51 may be an o-ring, a glyd ring or an equivalent. The seal groove 50 may be positioned along the piston bore 33 between the weep annulus 40 and the cam region 45. As the piston 37 reciprocates, fuel that migrates between the piston 37 and the piston bore 33 can be drawn into the weep annulus 40 and the drain gallery 48. Because the piston bore 33 is at a higher pressure than the low pressure pump inlet 26 when the migration of the fuel normally takes place, the migrating fuel is drawn to the low pressure inlet 26 before reaching the cam region 45 in which the oil is being circulated. Any fuel not drawn into the weep annulus 40 can be sealed from the cam region 45 via the seal 51.

Figure 4:
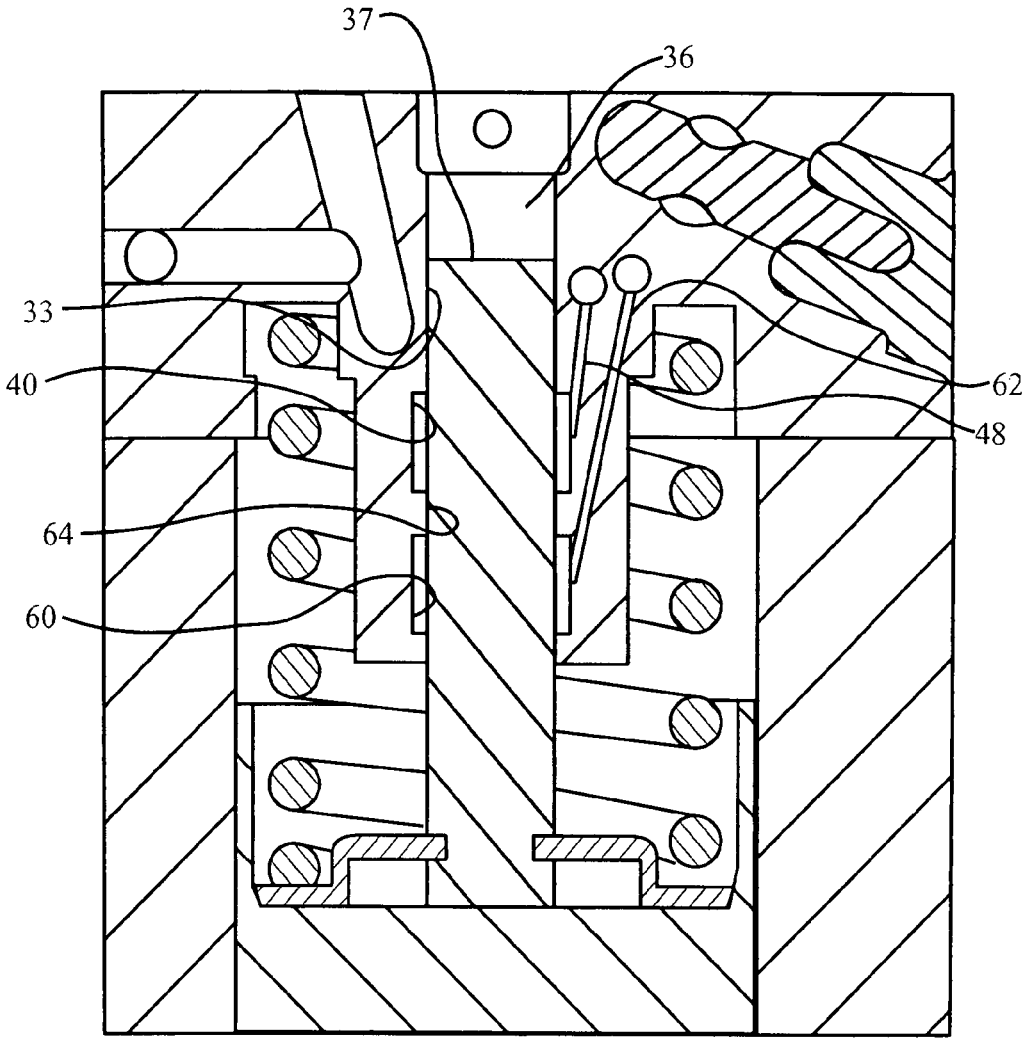
FIG. 4 is a sectioned view of a portion of a high pressure pump according to another embodiment of the present disclosure.

According to another exemplary embodiment, an annulus 60 that opens to piston bore 33 may also be provided. Referring now to FIG. 4, annulus 60 is spaced apart from weep annulus 40 by a region 64 of piston bore 33 and is located along the length of piston bore 33 between weep annulus 40 and cam region 45. Annulus 60 is fluidly connected to the lubrication fluid inlet 27 via a lubrication fluid gallery 62 defined by the high pressure pump housing 17. Seal groove 50, in which seal 51 may be positioned, may optionally be positioned along the piston bore 33 between annulus 60 and cam region 45. As the piston 37 reciprocates, fuel that migrates between the piston 37 and the piston bore 33 should be drawn into the weep annulus 40 and the drain gallery 48. Because the piston bore 33 is at a higher pressure than the low pressure pump inlet 26 when the migration of the fuel normally takes place, the migrating fuel is drawn to the low pressure inlet 26 before reaching the cam region 45 in which the lubrication fluid is being circulated. Similarly, because the lubrication fluid inlet 27 is at a higher pressure than the low pressure pump inlet 26, any lubrication fluid that migrates between the piston 37 and the piston bore 33 should be drawn into the weep annulus 40 and the drain gallery 48. The migration of the lubrication fluid from annulus 60 toward weep annulus 40 serves to create a seal or barrier that prevents, or substantially prevents, any flow of fuel past weep annulus 40 (in the opposite direction as the flow of the lubrication fluid). Although some of the lubrication fluid from annulus 60 may flow towards cam region 45 (which will generally be at a lower pressure), any such flow would be inconsequential, as the cam region 45 is full of the same lubrication fluid.

The amount of lubrication fluid that migrates from annulus 60 toward weep annulus 40 may be at least partially determined by the clearance between the piston 37 and the piston bore 33. In general, the larger the clearance (or the larger the space between piston 37 and piston bore 33), the more lubrication fluid will be able to migrate to weep annulus 40. According to one exemplary embodiment, the clearance between the piston 37 and the piston bore 33 is relatively small, generally resulting in the migration of only a small or minimal amount of lubrication fluid to weep annulus 40. The transfer of lubrication fluid to weep annulus 40 and the transfer of fuel to annulus 60 may be altered by adjusting the length of region 64. For example, according to one exemplary embodiment, any such transfer may be reduced by configuring region 64 to have a length that is greater than the stroke of piston 37. When region 64 is configured in this way, the ability of piston 37 to drag or carry lubrication fluid from annulus 60 to weep annulus 40, or to drag or carry fuel from weep annulus 40 to (or even past) annulus 60, as the piston 37 reciprocates is reduced, as no particular point on the piston 37 will pass through or into both weep annulus 40 and annulus 60. According to various exemplary and alternative embodiments, any reasonable clearance may be provided between the piston 37 and the piston bore 33. According to other various exemplary and alternative embodiments, the region 64 may have any length that is suitable for a particular application.

The high pressure pump housing 17 may optionally define a debris basin 49 fluidly connected to the low pressure fuel supply gallery 39. The debris basin 49 is a cavity defined by the barrel 35 that extends below the bottom fill port 52 connected to the pumping chamber 36. Thus, gravity can pull debris that is heavier than the fuel entering the bottom fill port 52 into the debris basin 49 rather than allow it to enter the pumping chamber 36. Optionally, the present disclosure includes a debris basin for each piston bore.

INDUSTRIAL APPLICABILITY

Referring to FIGS. 1-4, systems for, and methods of, reducing fluid mixing within the high pressure pump 14 of the compound pump assembly 16 will be discussed. Although the operation of the systems and methods will be discussed in connection with the fuel system 10, it should be appreciated that they can work similarly for any fluid system including a low pressure fluid pump and a high pressure fluid pump. Moreover, the low pressure pump and the high pressure pump need not be part of a compound pump as illustrated. Further, although the systems and methods described herein will be discussed in connection with one piston bore 33, it should be appreciated that they operate similarly for multiple piston bores.

Lubrication fluid, illustrated in the present disclosure as oil, is supplied to the high pressure pump 14 from the source of lubrication fluid 29 via the lubrication fluid supply line 30. The oil is generally drawn from the source 29 via a pump (not shown) and circulated through the cavities of the high pressure pump 14, including the cam region 45 defined by the cam housing 46. The oil will lubricate the moving cam 42 and the tappet 43. It is possible for a limited amount of oil to migrate between the piston 37 and the piston bore 33 (and past the seal 51 if it is provided) in which case it will mix with fuel and be evacuated through weep annulus 40 and ultimately be burned along with fuel in the combustion chamber. The oil that does not migrate past the seal 51 can return to the lubrication fluid source 29 via the lubrication return line 31.

A second fluid, being fuel, is pumped from the fuel tank 19 to the high pressure pump 14 via the low pressure pump 15. It should be appreciated that although the high pressure pump housing 17 is attached to the low pressure pump housing 18, the present disclosure contemplates the two pumps being separated and detached from one another. The fuel will flow from the low pressure pump outlet 25 to the high pressure pump inlet 24 and into the low pressure fuel supply gallery 39 of the high pressure pump 14 until drawn into a pumping chamber 36 for pressurization.

The pressure of the fuel is increased within the pumping chamber 36 within the piston bore 33 of the high pressure pump 14. Although the present disclosure discusses only one piston 37/piston bore 33 pair, it should be appreciated that the second piston/piston bore pair operates similarly, except that the pistons reciprocate out of phase with one another. Moreover, it should be appreciated that the present disclosure could be used with a pump having any number of piston bores, including only one, or with a pump that utilizes one spill control valve for each bore. As piston 37 undergoes its retracting stroke, fuel will be drawn into the pumping chamber 36 via the low pressure fuel supply gallery 39. Because the spill control valve 47 does not fluidly connect the low pressure fuel supply gallery 39 with the pumping chamber 36 while the piston 37 is retracting, the fuel will flow into the pumping chamber 36 via the inlet check valve 44 and bottom fill port 52. Positioned below the bottom fill port 52 and fluidly connected to the low pressure fuel supply gallery 39 may be the debris basin 49. The debris basin 49 is a cavity that can collect debris from the fuel within the low pressure fuel supply gallery 39 before the fuel flows into the bottom fill port 52. Due to gravity, at least some of the debris may separate from the fuel and collect in the debris basin 49 while the fuel is drawn into the pumping chamber 36 via the bottom fill port 52. Because the debris is separated from the fuel and kept out of the pumping chamber 36, the debris is less likely to interfere with the motion of the piston 37 and cause pump seizure.

As the piston 37 undergoes its pumping stroke, the pumping chamber 36 will be either fluidly connected to the low pressure fuel supply gallery 39 via the spill control valve 47 or fluidly connected to the high pressure gallery 38, depending on the position of the spill control valve 47. When the spill control valve 47 is open, the advancing piston 37 will push the fuel into the low pressure supply gallery 39. When there is a desire to output high pressure fuel from the pump 14, the electrical actuator of the spill control valve 47 is activated, thereby closing the spill control valve 47 and blocking the flow of fuel to the low pressure supply gallery 39 and forcing the pressurized fuel to flow past the outlet check valve and into the high pressure gallery 38. Although the present disclosure includes a single spill control valve 47 to control the fuel output from the pump 14, it should be appreciated that the present disclosure contemplates use with multiple spill control valves, and with pumps without spill control valves and/or without variable discharge capabilities.

As the piston 37 advances, the increased pressure within the pumping chamber 36 can cause some of the fuel to migrate between the piston 37 and the sides of the piston bore 33. The retracting action of the piston 37 can also drag some of the fuel between the piston 37 and the piston bore 33. Similarly, as the piston 37 advances, the piston 37 will tend to want to drag some of the lubrication fluid into the piston bore 33. Moreover, to the extent the pressure of the fluid within the weep annulus 40 is less than the pressure of the lubrication fluid, the lubrication fluid will tend to want to flow toward the weep annulus 40.

According to one exemplary embodiment, the mixing of the fuel with the oil is reduced, at least in part, by fluidly connecting the weep annulus 40 to the low pressure inlet 26 of the low pressure pump 15. As the fuel migrates down the piston bore 33 and the piston 37, the fuel will reach the weep annulus 40. The pressure differential between the piston bore 33 and the low pressure fuel flowing into the low pressure pump inlet 26 will draw the fluid from the weep annulus 40 to the low pressure pump inlet 26 via the drain gallery 48 and drain line 32. Because the drain line 32 is fluidly connected to the low pressure inlet 26 via the T-connection 41, the drain line 32 is fluidly connected to the flow of the low pressure fuel from the fuel tank 19 to the low pressure pump 15. Thus, the T-connection 41 may further increase the pressure differential that causes evacuation of the weep annulus 40. If any fuel is not evacuated through the weep annulus 40, but rather continues to migrate down the piston bore 33, the seal 51 can seal the fuel within the piston bore 33 from the oil within the cam region 45. Similarly, the seal 51 can seal oil being draw into the piston bore 33 via the reciprocating action of the piston 37 from mixing with the fuel. If some oil does migrate past the seal 51, the oil will be drawn into the weep annulus 40 and circulated back through the pumps 14 and 15, forwarded to the fuel injectors 11 and burned with other fuel. Those skilled in the art will appreciate that fuel within the lubrication fluid system is much less desirable than a small amount of oil within the fuel system 10. Fuel within the oil can undermine lubricity and cause damage to the moving parts intended to be lubricated. Although burning lubrication fluid as part of the combustion process may affect the emissions of the engine, that effect may be negligible (depending on the amount of lubrication fluid that is burned), it may be offset by aftertreatment systems, or the effect on the emissions may be acceptable for the application in which the pump is used. For example, for some marine engines, such as those using heavy fuels, burning lubrication fluid along with the fuel will have either a negligible effect on the emissions, or whatever effect it does have will still be acceptable under the regulations setting the standards for acceptable emissions levels.

According to another exemplary embodiment, the mixing of the fuel with the oil is reduced, at least in part, by fluidly connecting the weep annulus 40 to the low pressure inlet 26 of the low pressure pump 15 and the annulus 60 to the lubrication fluid inlet 27. As the fuel migrates down the piston bore 33 and the piston 37, the fuel will reach the weep annulus 40. The pressure differential between the piston bore 33 and the low pressure fuel flowing into the low pressure pump inlet 26 will draw the fluid from the weep annulus 40 to the low pressure pump inlet 26 via the drain gallery 48 and drain line 32. Because of the pressure differential between the lubrication fluid within annulus 60 and the fluid within weep annulus 40, the lubrication fluid will also be drawn toward weep annulus 40. As the lubrication fluid migrates up the piston bore 33 and the piston 37, the lubrication fluid will reach weep annulus 40. Any fuel is prevented, or substantially prevented, from migrating down the piston bore 33 and the piston 37 beyond the weep annulus 40 by the lubrication fluid from annulus 60 that is flowing toward weep annulus 40, in the opposite direction as the fuel. Thus, the lubrication fluid traveling up the piston bore 33 and the piston 37 forms a type of fluid seal that prevents, or substantially prevents, the flow of fuel past it. If any lubrication fluid migrates down the piston bore 33 rather than toward weep annulus 40, there will be no harm because it will simply join the lubrication fluid already within the cam region 45. Optionally, the seal 51 could also be used to seal the lubrication fluid within the piston bore 33 from the lubrication fluid within the cam region 45. The lubrication fluid that is drawn into the weep annulus 40 will be circulated back through the pumps 14 and 15, forwarded to the fuel injectors 11 and burned with other fuel.

The systems and methods described herein may be advantageous because they reduce the risk of fluid mixing due to fuel to oil migration and the risk of debris within the piston bore 33. In order to reduce the mixing of the fuel and the oil, one embodiment of the systems and methods described herein utilizes the pressure differential between the low pressure fluid flowing into the low pressure pump inlet 26 and the pressure of the fluid between the piston 37 and the piston bore 33 to continuously draw the fuel from the weep annulus 40. Because the pressure within the piston bore 33 generally remains at a higher pressure than the pressure of the low pressure pump inlet 26, the fuel and oil migrating to the weep annulus 40 will be continuously evacuated through the drain line 32 rather than migrating down the piston bore 33 and into the oil within the cam region 45. The T-connection 41 between the drain line 32 and low pressure pump inlet 26 may further increase the pressure differential, and thus, the suction drawing the fuel away from the piston bore 33. Another embodiment of the present disclosure utilizes not only the pressure differential between the low pressure fluid flowing into the low pressure pump inlet 26 and the pressure of the fluid within the piston bore 33 to continuously draw the fuel from the weep annulus 40, but in addition utilizes the pressure differential between the low pressure fluid flowing into the low pressure pump inlet 26 and the pressure of the lubrication fluid within a second annulus 60 to continuously draw the lubrication fluid from the second annulus 60 to the weep annulus 40. The flow of the lubrication fluid from the second annulus 60 to the weep annulus 40 creates a seal or barrier that prevents, or substantially prevents, the flow of fuel past the seal or barrier. Any lubrication fluid that is evacuated through weep annulus 40 is eventually mixed with the fuel and burned along with the fuel during the combustion process. In addition, the seal 51 may be utilized to provide added protection against fuel to oil mixing by sealing the piston bore 33 from the cam region 45 and vice versa. Because the mixing of fuel and oil is reduced, the high pressure pump 14 and other engine components can be more sufficiently lubricated by the oil, leading to a longer life and more efficient operation.

The systems and methods described herein may also be advantageous because the high pressure pump 14 may be more debris-resistant, meaning the likelihood that debris within the fuel will enter the pumping chamber 36 is reduced. Gravity may be utilized to separate at least some of the debris from the fuel before it flows into the pumping chamber 36. The weight of the debris will cause the debris to collect in the debris basin 49 while the fuel flows into the pumping chamber 36 via the bottom fuel port 52. Because at least some of the debris is separated from the fuel before it enters the pumping chamber 36, the risk of the debris interfering with the reciprocating action of the piston 37 is reduced, thereby increasing the likelihood that the pump 14 will function properly.

It should be understood that the description provided herein is intended for illustrative purposes only, and is not intended to limit the scope of the systems and methods described herein in any way. Thus, those skilled in the art will appreciate that other aspects, objects, and advantages of the disclosed systems and methods can be obtained from a study of the drawings, the disclosure and the appended claims.

What is claimed is:

1. A compound pump assembly for use with a fuel source, the compound pump assembly comprising:

a housing;

a low pressure pump disposed in the housing and including a low pressure pump inlet fluidly coupled to the fuel source and a low pressure pump outlet, the low pressure pump having a continuous low pressure pump inlet pressure at the low pressure pump inlet;

a high pressure pump disposed in the housing and including a high pressure pump inlet fluidly coupled to the low pressure pump outlet, a lubrication fluid inlet, a high pressure pump outlet, and a piston bore fluidly coupled to the high pressure pump inlet and the high pressure pump outlet;

a piston moveable within the piston bore;

a first annulus formed in the piston bore;

a second annulus formed in the piston bore and spaced from the first annulus, the second annulus being fluidly coupled to the low pressure pump inlet; and a lubrication fluid source fluidly coupled to the lubrication fluid inlet and the first annulus, the lubrication fluid having a continuous lubrication fluid pressure that is greater than the low pressure pump inlet pressure.

2. The compound pump assembly of claim 1, wherein the high pressure pump housing defines a cam region and wherein the cam region is fluidly coupled to the lubrication fluid inlet.

3. The compound pump assembly of claim 1, wherein a pumping chamber is provided at a first end of the piston bore and a cam region is provided at a second end of the piston bore.

4. The compound pump assembly of claim 1, wherein the first annulus is located along the length of the piston bore between the second annulus and the cam region.

5. A fuel system for use with high pressure fuel rail, the fuel system comprising:

a fuel source;

a lubrication fluid source having lubrication fluid at a continuous lubrication fluid pressure;

a low pressure pump including a low pressure pump inlet fluidly coupled to the fuel source and a low pressure pump outlet, the low pressure pump having a continuous low pressure pump inlet pressure at the low pressure pump inlet that is less than the lubrication fluid pressure;

a high pressure pump including a high pressure pump inlet fluidly coupled to the low pressure pump outlet, a high pressure pump outlet fluidly coupled to the high pressure fuel rail, a lubrication fluid inlet fluidly coupled to the lubrication fluid source, and a piston bore fluidly coupled to the high pressure pump inlet and the high pressure pump outlet;

a piston moveable within the piston bore, the piston having a first end exposed to the fuel and a second end exposed to the lubrication fluid;

a first annulus within the piston bore fluidly coupled to the lubrication fluid inlet; and a second annulus within the piston bore fluidly coupled to the low pressure pump inlet; and at least one fuel injector fluidly coupled to the high pressure pump outlet.

6. The fuel system of claim 5, wherein the lubrication fluid is oil.

7. The fuel system of claim 5, wherein the second annulus is spaced apart from the first annulus along the length of the piston bore.

8. The fuel system of claim 5, wherein the housing defines a cam region and wherein the cam region is fluidly coupled to the lubrication fluid inlet.

9. The fuel system of claim 5, wherein a pumping chamber is provided at a first end of the piston bore and a cam region is provided at a second end of the piston bore.

10. The fuel system of claim 9, wherein the first annulus is located along the length of the piston bore between the second annulus and the cam region.

11. The fuel system of claim 5, in which the piston bore is disposed at a piston bore pressure, and in which the low pressure pump inlet pressure is less than the piston bore pressure.

12. The fuel system of claim 5, in which the lubrication fluid pressure is at least approximately 600 kilopascals.

13. The compound pump assembly of claim 1, in which the piston bore is disposed at a piston bore pressure, and in which the low pressure pump inlet pressure is less than the piston bore pressure.

14. The compound pump assembly of claim 1, in which the lubrication fluid pressure is at least approximately 600 kilopascals.

* * * * *